US007029581B2

(12) United States Patent
Horan

(10) Patent No.: US 7,029,581 B2
(45) Date of Patent: Apr. 18, 2006

(54) LUBRICANT PARTICLE COLLECTOR HAVING A CONNECTOR WITH A BALL LOCKING MECHANISM

(75) Inventor: James L. Horan, Morton, PA (US)

(73) Assignee: Eaton Corporation, Cleveland, OH (US)

( * ) Notice: Subject to any disclaimer, the term of this patent is extended or adjusted under 35 U.S.C. 154(b) by 491 days.

(21) Appl. No.: 10/397,138

(22) Filed: Mar. 26, 2003

(65) Prior Publication Data

US 2004/0188335 A1 Sep. 30, 2004

(51) Int. Cl.
*B01D 35/06* (2006.01)

(52) U.S. Cl. ..... 210/223; 210/222; 210/532.1; 324/204; 251/149; 184/6.25; 137/614.04; 137/614.05

(58) Field of Classification Search ..... 210/222, 210/223, 532.1; 324/204; 251/149; 184/6.25, 184/106; 137/614.04, 614.05
See application file for complete search history.

(56) References Cited

U.S. PATENT DOCUMENTS

| | | | | |
|---|---|---|---|---|
| 3,211,291 | A * | 10/1965 | Teutsch | 210/223 |
| 4,199,443 | A | 4/1980 | Tauber | |
| 5,334,932 | A * | 8/1994 | Nielsen | 324/204 |
| 5,588,502 | A * | 12/1996 | Bedi et al. | 210/222 |
| 5,782,141 | A | 7/1998 | Schoolcraft et al. | |
| 6,234,274 | B1 * | 5/2001 | van der Griendt | 184/106 |
| 6,354,564 | B1 * | 3/2002 | Van Scyoc et al. | 251/149 |

FOREIGN PATENT DOCUMENTS

| | | |
|---|---|---|
| DE | 32 21 778 A1 | 11/1983 |
| EP | 0 309 131 | 3/1989 |
| FR | 2 370 208 | 6/1978 |
| FR | 2 734 883 | 12/1996 |
| JP | 2000 193172 | 7/2000 |

OTHER PUBLICATIONS

Vickers Product Brochure for Quick Disconnect Chip Collectors for V2500 Engines, 1997.
Vickers Product Brochure for Quick Disconnect Chip Collectors for JT8D Engines, 1997.
Vickers Product Brochure for Quick Disconnect Chip Collectors for PW4000 Engines, 2001.

* cited by examiner

*Primary Examiner*—David A. Reifsnyder
(74) *Attorney, Agent, or Firm*—George E. Haas; Quarles & Brady LLP

(57) ABSTRACT

A removable particle collector for an apparatus which separates metal particles from lubricating oil. A valve assembly has a bore that provides a passage into the reservoir from outside. A valve element is normally biased against a valve seat to close the bore. A plug has a stem which when inserted into the valve assembly bore forces the valve element away from the valve seat. A portion of the stem is magnetized to attract ferromagnetic particles in the reservoir. A plurality of balls rotatably project from a surface on either the valve assembly or the plug and are received in a plurality of locking grooves in the other of the valve assembly and the plug to secure those components together. The balls are lubricated by fluid from the reservoir and can rotate to reduce wear which could loosen the components.

23 Claims, 4 Drawing Sheets

LUBRICANT PARTICLE COLLECTOR HAVING A CONNECTOR WITH A BALL LOCKING MECHANISM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to apparatus for separating metal particles from lubricating oil in which the particles are suspended, and to devices for collecting and measuring the quantity of separated metal particles in such apparatus. More particularly the present invention is related to quick connect and disconnect mechanisms to attach the collecting and measuring device to the particle separating apparatus in a removable manner.

2. Description of the Related Art

Mechanical power transmission equipment is subject to wear due to friction caused by the contact of moving parts under pressure at relatively high speeds. This results in abrasive wearing of component surfaces with the resulting release of small particles. Such "wear particles" are generally less then twenty microns in size and become suspended in the oil used to lubricate the moving components.

It is desirable to remove such particles from suspension in the lubricating oil to prevent them from being re-circulated with the oil and further contributing to the abrasion of the moving parts. U.S. Pat. No. 4,199,443 discloses an apparatus for removing the particles suspended in the lubricating oil. In this type of mechanism, the oil tangentially enters a cylindrical housing thereby producing rotary downward motion of the oil which creates a vortex in the housing. That vortex flow causes the heavier particles to be transported by centrifugal force against an outer wall and to the bottom of the housing where the particles accumulate. A filter is provided to remove particles which would otherwise remain suspended in the oil flowing through the apparatus.

A collector is mounted at the bottom of the chamber to gather the accumulated particles. A common type of collector incorporates a permanent magnet to attract ferromagnetic particles from moving machine parts that are made of steel. Periodically, a mechanic removes the collector to inspect the accumulation of particles thereon and determine an amount of wear of the machine components. Another type of collector includes a sensor with electrical contacts adjacent the permanent magnet and the accumulation of metal particles forms an electrical bridge between the contacts. The amount of metal particle accumulation can be determined by measuring the electrical conductivity between those contacts.

All types of these collectors must be periodically detached from the separator housing in order to remove the accumulated particles. As a consequence, a quick connect and disconnect mechanism has been employed to attach the collector to the housing of the particle separator. A "bayonet" connector commonly is used in which two or more cylindrical pins are fixed to either the collector device or a mating fitting secured to the housing. The other component included a like number of grooves, often having a J or L shape, with each groove receiving one of the pins.

The cylindrical pins tended to wear due to vibration of the machinery on which the particle removal apparatus was located. The vibration applied forces in orthogonal directions on the pin. The vibration induced wear loosened the fit between the particle collector and the separator housing. Such loosening of the collector enabled the lubricating oil to leak from the apparatus. If such pin wear was allowed to continue undetected, the collector occasionally detached from the separator housing.

As a consequence, it is desirable to provide an alternative quick connect and disconnect mechanism for holding such collectors onto particle separators.

SUMMARY OF THE INVENTION

A collector is provided to gather metal particles in a reservoir of an apparatus which separates the particles from lubricating oil. The collector includes a valve assembly with a bore that forms a passage between inside and outside of the reservoir. The valve assembly has a cylindrical first surface outside the reservoir. A plug has a stem that is removably received within the bore of the valve assembly and has a body with a cylindrical second surface which mates with the first surface.

A plurality of balls rotatably project from one of the first surface and second surface. The other of the first surface and second surface has a plurality of locking grooves, in which the plurality of balls are releasably received to secure the valve assembly and plug together.

The design of the preferred embodiment of the collector is such that lubricating oil from the reservoir is able to flow to the balls, This lubrication of the balls and the balls ability to rotate while securing the collector components together reduces wear which tends to loosen the connection between those components.

Another preferred aspect of the present collector is magnetizing a portion of the plug stem to attract ferromagnetic particles in the reservoir. Electrodes may be provided on the magnetized portion of the plug stem to electrically sense the accumulation of the ferromagnetic particles.

Another embodiment of the present invention provides a collector for non-ferromagnetic particles in the reservoir. This collector has a screen through which the lubricating oil flows to thereby trap the particles.

DETAILED DESCRIPTION OF THE INVENTION

Figure 1:
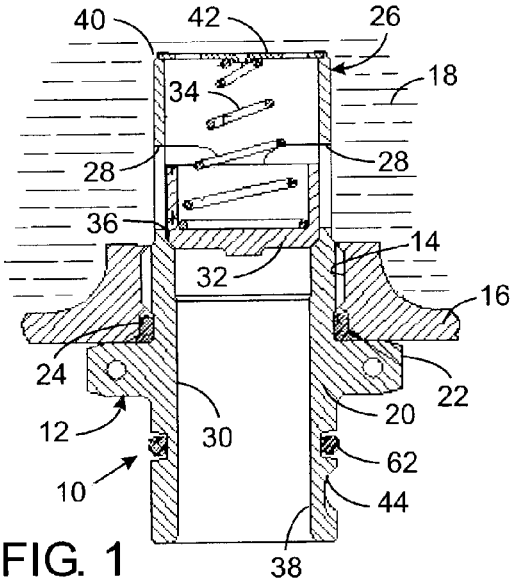
FIG. 1 is a cross-sectional view through a valve assembly of a collector that incorporates a connector according to the present invention.

With initial reference to FIG. 1, a particle collector 10 has a valve assembly 12 which is threaded into an aperture 14 in a reservoir 16 or other section of a machine lubrication system which contains lubricating oil 18. The valve assembly 12 has a tubular housing 20 with a hexagonal flange 22 that abuts the outer surface of the reservoir 16. The tubular housing 20 has a threaded section 15 which engages threads in the reservoir aperture 14 to the hold the valve assembly 12 in place. An annular seal 24 blocks fluid from passing through the aperture 14.

Figure 2:
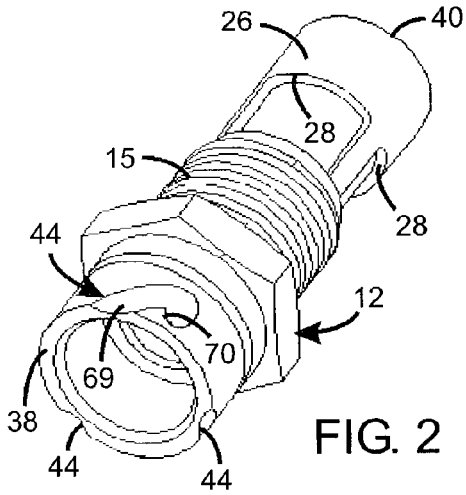
FIG. 2 is an isometric view of the valve assembly.

With additional reference to FIG. 2, an interior section 26 of the housing 20 which extends into the lubricating oil 18 has three rectangular apertures 28 in the curved outer wall, thereby providing paths through which the lubricating oil enters the longitudinal bore 30 of in the tubular housing 20. A valve element 32 is slidably received within the interior section 26 and is biased by a spring 34 against a valve seat 36 formed in the bore 30. Engagement of the valve assembly 32 with the valve seat 36 closes the bore 30 preventing the lubricating oil from flowing between the interior section 26 and an exterior section 38 of the valve assembly housing 20. The interior end 40 of the tubular housing 20 is closed by a plate 42 which is secured across the bore opening and which is engaged by one end of the spring 34.

Figure 3:
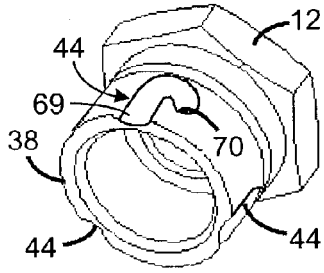
FIG. 3 is an isometric view of an alternative connector arrangement on the valve assembly.

As seen in FIG. 2, the exterior section 38 of the tubular housing 20 has three generally J-shaped locking grooves 44 spaced equidistantly around the outer circumferential surface. The grooves 44 are slanted about that surface thus resembling a "check mark". Alternatively, as shown in FIG. 3, the locking grooves 44 may more closely resemble the letter J with an elongated section 69 extending parallel to the longitudinal axis of the valve assembly 12 from the end of the plug. A notch 70 is located at the inner end of the elongated section 69 and extends to one side thereof. As will be described, each of these locking grooves 44 receives a ball located on a mating plug of the quick connector 10 in order to secure the plug on the valve assembly 12.

Figure 4:
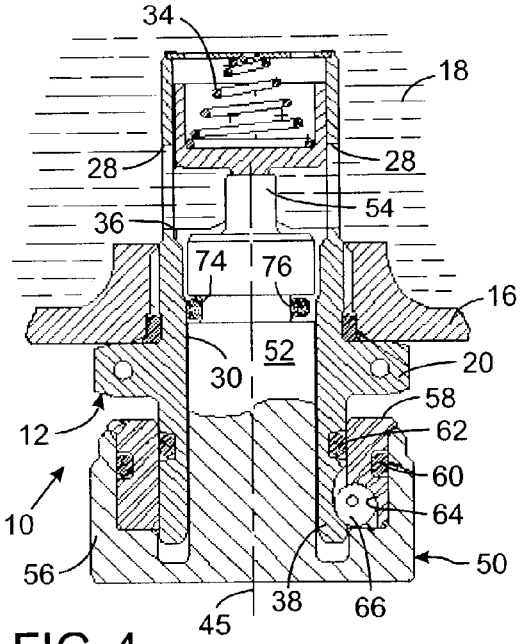
FIG. 4 is a cross-sectional view of the collector with a plug attached to the valve assembly.
Figure 5:
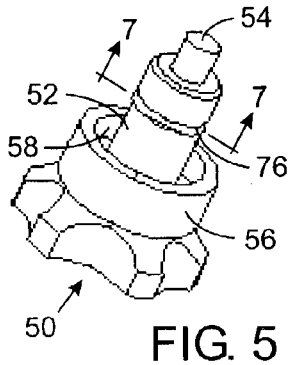
FIG. 5 is an isometric view of the collector plug.

Referring to FIGS. 4 and 5, a plug 50 is inserted through the exterior section 38 of the valve assembly 12. The plug 50 has a cylindrical stem 52 which extends into the bore 30 of the tubular housing 20. A nose 54 projects from the interior end of the stem 52 abutting the valve element 32 of the valve assembly 12. When the plug 50 is fully inserted into the valve assembly 12, the nose 54 pushes the valve element 36 away from the valve seat 36 and against the force of spring 34. This opens the bore 30 of the tubular housing 20.

The exterior end of the plug stem 52 has an integral body in the form of a cap 56 extending there around and encircling the exterior section 38 of the valve assembly 12. An annular retainer 58 is press fitted within the interior of the cap 56. A first sealing ring 60 provides a water tight interface between the retainer 58 and the interior of the cap 56. The interior diameter of the annular retainer 58 engages a second sealing ring 62 located in a groove around the exterior section 38 of the valve assembly 12 to provide a fluid seal there between. With additional reference to FIG. 6, the retainer 58 has three notches 64 spaced radially at equal increments around its interior diameter. A ball 66 is captivated in each of the notches 64 in the retainer 58. Specifically, the retainer 58 has notch lips 67 and 68 that extend around the ball to prevent it from traveling toward the stem 52 when the plug 50 is removed from the valve assembly 12.

When the plug 50 is inserted into the valve assembly 12, it is aligned rotationally so that each ball 66 enters an elongated section 69 of one of the locking grooves 44 in the exterior section 38 of the valve assembly. As the plug 50 is pushed farther into the valve assembly 12, it is rotated so that each of the balls 66 follows elongated section 69 of the locking groove 44. When the balls 66 reach the interior end of the locking grooves 44, the plug 50 can not be rotated further about the valve assembly 12. In this position, the installer releases the plug 50 which results in the force of spring 34 pushing the valve element 32 and the plug nose 54 slightly outward so that the balls 44 enter the notch 70 at the inner end of each locking groove 44. The balls 66 are captivated in the notches 70, thereby securing the plug 50 on the valve assembly 12.

Figure 6:
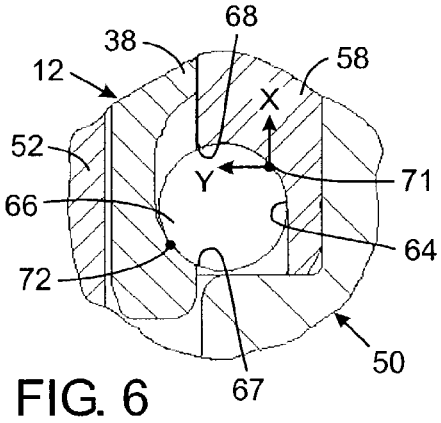
FIG. 6 is an fragmented cross-sectional view which shows a ball securing the plug to the valve assembly.

The force which the spring 34 exerts on the plug 50 minimizes the effects of vibration along the axis of the plug. The spring force also effects the vector load on the balls 66 which wedges the balls between the valve housing 20 and the plug 50 to fix the plug radially within the valve assembly. Referring to FIG. 6, the spring force is transferred along a line between point 71 where the ball 66 contacts the retainer 58 and point 72 at which the ball 66 contacts the locking groove 44 in the valve assembly 12. That line for each of the balls 66 intersects the longitudinal axis 45 of the plug 50 thereby centering the plug in the valve assembly bore 30 thereby minimizing the vibrational effects acting on the plug. The contours of the notches 64 and the locking grooves 44 are such that each ball 66 contacts those surfaces in only two places, which minimizes vibration in the X and Y directions.

Figure 7:
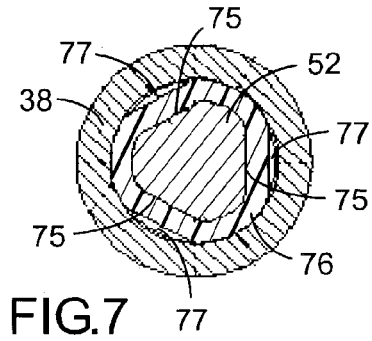
FIG. 7 is a cross-sectional view along line 7—7 in FIG. 5.

With reference to FIGS. 5 and 7, an annular groove 74 extends around the stem 52 of the plug 50. The bottom of this groove 74 has flat portions 75 so that the cross-section of the stem 52 at this point has the shape of a triangle with rounded apexes, as seen specifically in FIG. 7. A resilient, annular spacer 76 extends around the plug stem 52 within the groove 74 to dampen vibration of the stem within the bore 30 of the valve assembly 12 (see FIG. 3). Note that the triangular shape of the plug stem inside the groove 74 creates gaps 77 between the spacer 76 and the valve assembly bore 30 at three points around the plug stem 52. These gaps 77 allow lubricating oil that enters through apertures 28 to flow between the plug stem 52 and the valve assembly 12 into the cap 56 of the plug 50 and around the balls 66. This oil flow lubricates the balls, thereby reducing their wear that would otherwise result from vibrational forces. The second sealing ring 62, around the exterior section 38 of the valve assembly 12, prevents this lubricating oil from leaking through the particle collector 10.

FIG. 5 illustrates a basic version of the plug in which the nose 54 and adjacent section of the valve stem 52 are magnetized to form a permanent magnet. These magnetized portions of the plug 50 attract ferromagnetic particles suspended in the fluid 18 in the reservoir 16 which then collect on those portions. With this type of particle collector, a mechanic periodically removes the plug 50 to inspect the quantity of particles which have accumulated on the permanent magnet section. These particles may be removed from the plug before it is replaced on the valve assembly 12. Note with respect to FIG. 1 that when the plug 50 is removed from the valve assembly 12, the spring 34 forces the valve element 32 against the seat 36, thereby preventing escape of lubricating oil 18 from the reservoir 16.

Figure 8:
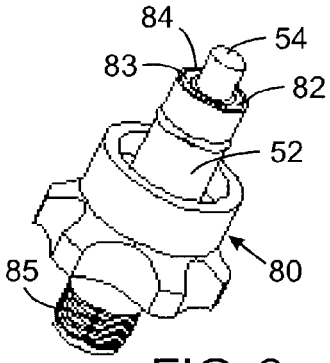
FIGS. 8–10 are isometric views of three alternative types of connector plugs.

FIG. 8 illustrates an alternative collector plug 80 which incorporates a particle sensor. In this component, the permanent magnetic nose 54 extends from a shoulder surface 82 of the plug stem 52. A pair of annular electrodes 83 and 84 are formed on the shoulder 82 extending around the nose 54. The electrodes 83 and 84 are connected to wires which run through the interior of the plug stem 52 to an electrical connector 85 at the exterior end of the plug. A cable that mates with the electrical connector 85 connects the electrodes 83 and 84 to equipment which senses current flow between the electrodes. As metal particles accumulate on the end of the plug stem 52, an electrical path is formed between electrodes 83 and 84. The conductivity of that electrical path increases with the accumulation of metal particles, so that the amount of particle accumulation can be sensed by measuring that conductivity without removing the plug 87 from the valve assembly 12.

Figure 9:
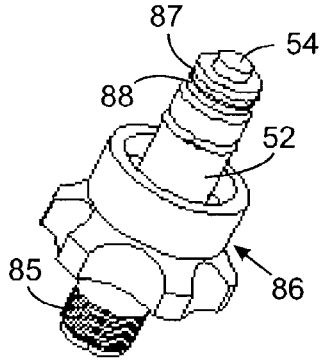

FIG. 9 illustrates another collector plug 86 which has an electrical particle sensor around the magnetized nose 54. This collector plug 86 includes two electrodes 87 and 88 extending around a circumferential surface at the inner end of the plug stem 52. The electrodes 87 and 88 are connected to wires which run through the interior of the plug stem 52 to an electrical connector 85 at the outer end of the plug 86. As with the embodiment in FIG. 7, the accumulation of metal particles at the inner end of the plug stem, due to its magnetization, creates an electrical path between the two electrodes 87 and 88.

Figure 10:
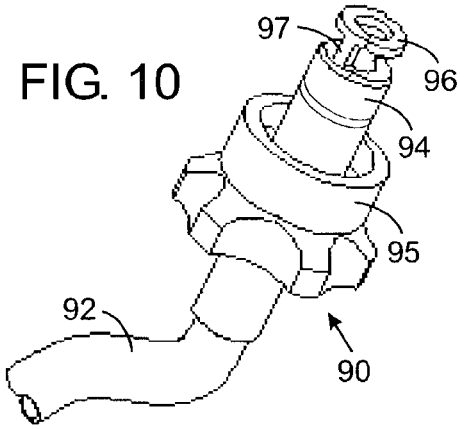

FIG. 10 illustrates a further type of plug 90 which attaches a hose or tube 92 to the reservoir 16. Specifically, plug 90 has a tubular housing 94 extending through the cap 95 with the tube 92 connected to the exterior end of the tubular housing. An end ring 96 is spaced from the interior end of the tubular housing 94 by a pair of posts 97 (only one of which is visible in the drawings). When the plug 90 is inserted through the valve assembly 12 in a manner similar to plug 50 in FIG. 3, the end ring 96 pushes the valve element 32 inward away from the valve seat 36. This enables fluid 18 from the reservoir 16 to enter the space between the end ring 96 and the tubular housing 94 and flow through the bore in the stem 94 into the tube 92. This plug and tube assembly shown in FIG. 10 can be utilized to introduce fluid into the reservoir 16 or remove fluid there from. It will be appreciated that a valve mechanism can be attached to the other end of the tube 92 in order to control the flow of oil through the tube.

Figure 11:
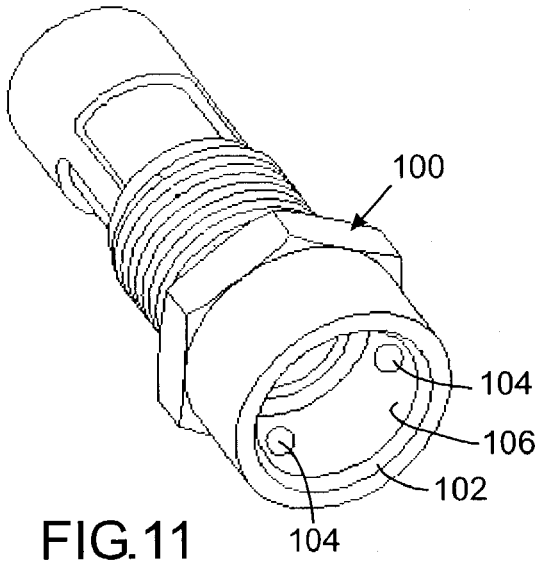
FIG. 11 is an isometric view of an alternative design of a valve assembly incorporating the present invention.
Figure 12:
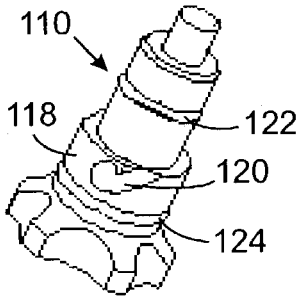
FIGS. 12–15 illustrate four types of collector plugs that can be utilized with the alternative valve assembly in FIG. 11.
Figure 13:
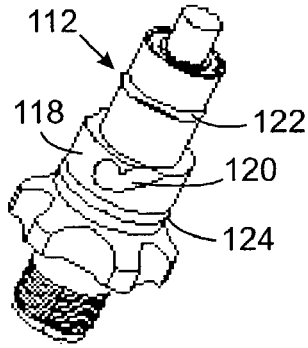
Figure 14:
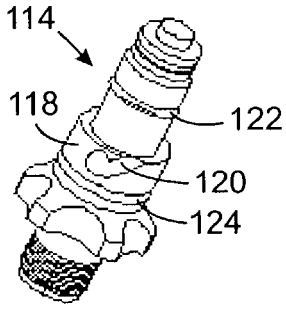
Figure 15:
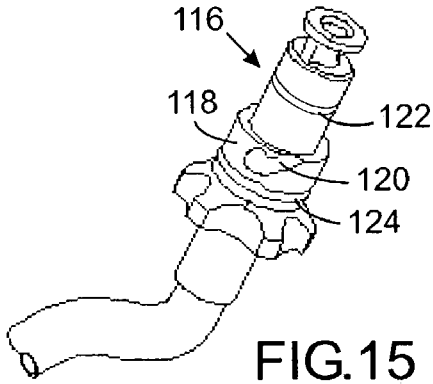

Referring to FIG. 11, an alternative version of the valve assembly 100 has a structure similar to that of the valve assembly 12 shown in FIGS. 1–3. However, this alternative valve element 100 does not have locking grooves on the outer surface of the exterior section 102. Instead, three balls 104 are held by a retainer 106 inside the bore of the valve assembly 100. The retainer 106 is similar to retainer 58 described with respect to the previous embodiment and captivates the balls 104 within the valve assembly 100. The balls engage grooves in the plug that mates with the valve assembly 100 thereby securing those components together.

Specifically, FIGS. 12, 13, 14 and 15 illustrate plugs 110, 112, 114 and 116 which correspond to the plugs in FIGS. 5, 8, 9 and 10 respectively. Each of these plugs 110–116 has a cylindrical body 118 with an exterior surface in which three locking grooves 120 are located to receive the balls 104 of the valve assembly 100. The locking grooves 120 have a J-shape which can either be aligned with the axis of the plug or slanted with respect thereto to have a check mark appearance. Each of these alternative plugs 110–116 has an annular spacer 122 which allows lubricating oil to flow from the reservoir along the plug stem to the balls 104 in grooves 120. This lubrication not only reduces wear of the abutting Surfaces, it also enables the balls to rotate in place due to the vibration thereby distributing what wear does occur over the entire surface of the ball. Therefore, unlike the fixed pins used in previous connectors, surface contact and wear are not limited to one section of each ball. An additional exterior seal 124 is provided around the plug's cylindrical body 118 to engage the valve assembly 100 and prevent that oil from leaking from the connector.

Figure 16:
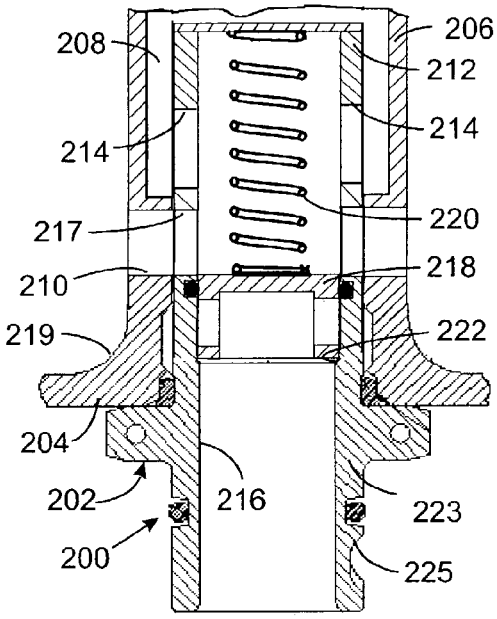
FIG. 16 is a cross-sectional view through a valve assembly of a collector for non-ferromagnetic particles.

With reference to FIG. 16, a third version of a particle collector 200 is provided for gathering non-ferromagnetic particles. With this version, the valve assembly 202 is threaded into an aperture in the particle separator 204 and extends into a tubular member 206. The lubricating oil flowing in the particle separator 204 enters an internal cavity 208 in the tubular member 206 and exits into the particle separator reservoir 219 through the second apertures 217 in the tubular member.

The valve assembly 202 has an interior tubular section 212 the end of which projects into the particle separator cavity 208 and has a plurality of apertures first spaced axially around the tubular section 212. The first apertures 214 form passages between the internal cavity 208 in the tubular member 206 and the longitudinal bore 216 of the valve assembly 202. A valve element 218 is slidably located within the longitudinal bore 216 and is biased by a spring 220 against a valve seat 222. When the valve element 218 engages the valve seat 222, the interior portion of the longitudinal bore 216 is closed off from the exterior portion in the same manner as with the previously described valve assemblies.

The exterior section 223 of the valve assembly 202 has a tubular construction which is identical to that of the exterior section 38 of the valve assembly 12 shown in FIGS. 1 and 2. Specifically, there are three locking grooves 225 spaced at equal increments axially around the exterior surface of the valve assembly's outer end.

When a plug is not inserted into the valve assembly 202 as seen in FIG. 16, lubricating oil flowing in the particle separator 204 enters an internal cavity 208 in the tubular member 206 from which the oil continues to flow into the longitudinal bore 216 of the valve assembly 202 entering through first apertures 214 The oil exits the longitudinal bore 216 through a plurality of second apertures 217 in the valve assembly and apertures 210 in the tubular member 206, thereby flowing into the particle separator reservoir 219.

Figure 17:
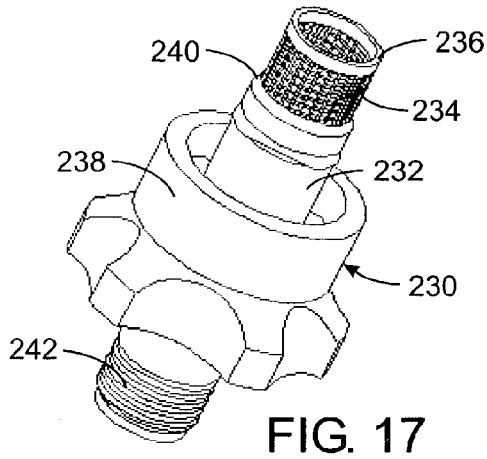
FIG. 17 is an isometric view of a plug that mates with the valve assembly in FIG. 16.

With reference to FIG. 17, a collector plug 230 has a body 238 from which a stem portion 232 projects. The interior end of the stem portion 232 has a cylindrical screen 234 fabricated of a non-electrically conducted material, such as a rigid plastic mesh. A metal ring 236 extends around the open end of the cylindrical screen 234 to form a first sensing electrode. A second sensing electrode 240 extends around the end of the stem 232 at the junction with the screen 234. Wires lead from the ring 236 and electrode 240 to a connector 242 at the exterior end of the plug 230. 100471 With reference to FIG. 18, the plug 230 has three balls 244 held within notches of a retainer 246 of the body 238. When the plug 230 is inserted into the valve assembly 202, it is aligned rotationally so that each ball 244 enters one of the locking grooves 222 in the valve assembly. The plug 230 is rotated as it is pushed farther onto the valve assembly, so that each ball 244 follows the locking groove 225. When the balls reach the interior ends of locking grooves, and the plug 230 cannot be rotated further about the valve assembly 202, the plug is released. At that time, the force exerted oil the plug 230 by valve assembly spring 220 forces the balls into the notches at the end of the groove, thereby securing the plug onto the valve assembly in the same manner as described herein in respect of the plugs.

Figure 18:
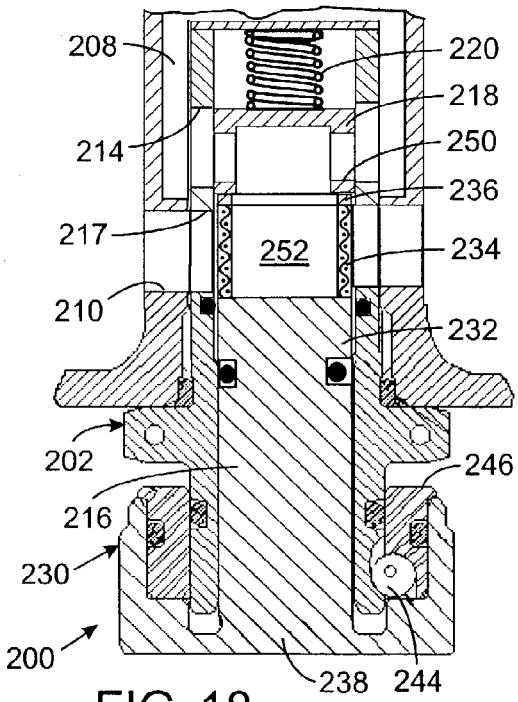
FIG. 18 is a cross-sectional view of the plug inserted into the valve assembly.

As the stem 232 of plug 230 is inserted into the bore 216 of the valve assembly 202, the ring 236 pushes the valve element 218 inward against the force of the spring 220. When the plug 230 is fully inserted into the valve assembly, as shown in FIG. 18, transverse apertures 250 the valve element 218 are aligned with the first apertures 214 in the valve assembly. This alignment provides a path between the particle separator cavity 208 and the interior of the valve element 218 which opens into center of the ring 236 and cylindrical screen 252 of the plug. This allows lubricating oil to flow into the interior of region 252 of the plug screen 234. The lubricating oil continues to flow laterally through the screen 234, second apertures 217 in the valve assembly 202, and apertures 210 in the tubular portion 206 of the particle separator. Therefore, the lubricating oil is circulated through the plug screen 234 before entering the reservoir 219 and the screen traps particles suspended in the lubricating oil. The accumulation of the metal particles on the screen 234 effects the conductivity between the end ring 236 and the electrode ring 240 on the plug 230. As described previously, that conductivity and thus the accumulation of non-ferromagnetic metal particles can be sensed by external circuitry.

In an alternative variation of the particle collector 200 in FIGS. 16–17 the locking grooves can be formed in the plug body 238 and the balls mounted in the exterior section 223 of the valve assembly 202. Both variations of the ball and groove locking mechanism for the valve assembly 202 and collector plug 230 have the same advantages over prior connecting mechanisms as described with respect to the other versions of the present invention.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A particle collector for a reservoir of an apparatus which separates metal particles from lubricating oil, said collector comprising:

a valve assembly attached through an aperture in the reservoir and having an tubular section with a cylindrical first surface extending outside the reservoir;

a plug having a body from which a stem extends, the stem is removably received within the tubular section and the body has a cylindrical second surface which mates with the first surface; and a plurality of balls rotatably projecting from one of the first surface and second surface;

wherein the other of the first surface and second surface has a plurality of locking grooves therein in which the plurality of balls are removably received to secure the valve assembly and plug together.

2. The particle collector as recited in claim 1 wherein each of the plurality of locking grooves has elongated section, and a notch at an end of the elongated section and extending to one side thereof.

3. The particle collector as recited in claim 2 wherein the elongated section of each of the plurality of locking grooves extends parallel to a longitudinal axis of the plug.

4. The particle collector as recited in claim 2 wherein the elongated section of each of the plurality of locking grooves extends transverse to a longitudinal axis of the plug.

5. The particle collector as recited in claim 1 wherein a portion of the stem of the plug is magnetized to attract ferromagnetic particles in the reservoir.

6. The particle collector as recited in claim 5 further comprising two electrodes on the portion of the stem for sensing accumulation of ferromagnetic particles.

7. The particle collector as recited in claim 1 further comprising a sensor on the stem of the plug to detect particles in the reservoir.

8. The particle collector as recited in claim 1 wherein the stem of the plug has a screen which traps particles in lubricating oil circulating through the valve assembly.

9. The particle collector as recited in claim 1 wherein the stem of the plug has an aperture there through and a conduit attached to an exterior portion of the stem in fluid communication with the aperture.

10. The particle collector as recited in claim 1 further comprising a valve seat formed inside the tubular section of the valve assembly; and a valve clement within the tubular section and moveably biased against the valve seat when the plug is removed from the valve assembly and forced away from the valve seat when the plug is inserted into the valve assembly.

11. The particle collector as recited in claim 1 further comprising an annular groove extending around the stem of the plug and having a bottom surface with at least one fiat portion; and a resilient, annular spacer extending around the stem within the groove and spaced from the first surface of the valve assembly adjacent the at least one flat portion to allow lubricating oil to flow past the annular spacer to the balls.

12. A particle collector for a reservoir of an apparatus which separates metal particles from lubricating oil, said particle collector comprising:

a valve assembly having a housing attached to the reservoir with a bore extending between inside and outside the reservoir, a valve seat formed in the bore, and a valve element biased toward engagement with the valve seat, the valve assembly further including a cylindrical first surface extending outside the reservoir with a plurality of locking grooves therein;

a plug having a stem which is removably received within bore of the valve assembly and forcing the valve element away from the valve seat, a portion of she stern being magnetized to attract ferromagnetic particles in the reservoir, the plug having a cylindrical second surface which mates with the first surface; and a plurality of balls rotatably projecting from the second surface of the plug and being releasably received in the plurality of locking grooves in the first surface to secure the plug to the valve assembly.

13. The particle collector as recited in claim 12 wherein each of the plurality of locking grooves baa an elongated section extending parallel to a longitudinal axis of the plug, and a notch at an end of the elongated section and extending to one side thereof.

14. The particle collector as recited in claim 12 wherein each of the plurality of locking grooves has elongated section extending transverse to a longitudinal axis of the plug, and a notch at an end of the elongated section and extending to one side thereof.

15. The particle collector recited in claim 12 further comprising two electrodes on the portion of the stem for sensing accumulation of ferromagnetic particles.

16. The particle collector as recited in claim 12 wherein the stem of the plug includes a screen in which taps particles in the lubricating oil circulating through the valve assembly.

17. The particle collector as recited in claim 12 further comprising an annular groove extending around the stern of the plug and having at bottom surface with at least one flat portion; and a resilient, annular spacer extending around the stem within the groove and spaced from the first surface of the valve assembly adjacent the at least one flat portion to allow lubricating oil to flow past the annular spacer to the balls.

18. A particle collector for a reservoir of an apparatus which separates metal particles from lubricating oil, said particle collector comprising:

a valve assembly having a housing attached to the reservoir with a bore extending between inside and outside the reservoir, a valve scat formed in the bore, and a valve element normally biased against the valve seat, the valve assembly further including a cylindrical first surface extending outside the reservoir;

a plug having a stem which is removably received within the bore of the valve assembly and forcing the valve element away from the valve seat, a portion of the stem being magnetized to attract ferromagnetic particles in the reservoir, the plug having a cylindrical second surface which mates with the first surface and which has a plurality of locking grooves therein; and a plurality of halls rotatably projecting from the first surface of the valve assembly and being releasably received in the plurality of locking grooves in the second surface so secure the plug to the valve assembly.

19. The particle collector as recited in claim 18 wherein each of the plurality of locking grooves has an elongated section extending parallel to a longitudinal axis of the plug, and a notch at an end of the elongated section and extending to one side thereof.

20. The particle collector as recited in claim 18 wherein each of the plurality of locking grooves has an elongated section extending transverse to a longitudinal axis of the plug, and a notch at an end of the elongated section and extending to one side thereof.

21. The particle collector as recited in claim 18 further comprising two electrodes on the portion of the stem for sensing accumulation of ferromagnetic particles.

22. The particle collector as recited in claim 18 wherein the stem of the plug includes a screen in which traps particles in the lubricating oil circulating through the valve assembly.

23. The particle collector as recited in claim 18 further comprising an annular groove extending around the stem of the plug and having at bottom surface with at least one flat portion; and a resilient, annular spacer extending around the stem within the groove and spaced from the first surface of the valve assembly adjacent the at least one flat portion to allow lubricating oil to flow past the annular spacer to the balls.

* * * * *